United States Patent [19]

Kelly et al.

[11] Patent Number: 4,508,134

[45] Date of Patent: Apr. 2, 1985

[54] CONTROLLING EGR IN AN INTERNAL COMBUSTION ENGINE AND FLUID PRESSURE SIGNAL CONTROLLER THEREFOR

[75] Inventors: William W. Kelly, Battle Creek; Cyril E. Bradshaw, Kalamazoo, both of Mich.

[73] Assignee: Eaton Corporation, Cleveland, Ohio

[21] Appl. No.: 618,709

[22] Filed: Jun. 8, 1984

Related U.S. Application Data

[62] Division of Ser. No. 379,844, May 20, 1982.

[51] Int. Cl.[3] ..... F02M 25/06

[52] U.S. Cl. ..... 137/103; 123/568; 137/DIG. 8

[58] Field of Search ..... 123/568; 137/103, 116.5, 137/DIG. 8

[56] References Cited

U.S. PATENT DOCUMENTS

| | | | |
|---|---|---|---|
| 4,196,707 | 4/1980 | Stoltman | 123/568 X |
| 4,202,524 | 5/1980 | Brakebill | 123/568 X |
| 4,365,608 | 12/1982 | Bradshaw | 123/568 |
| 4,373,495 | 2/1983 | Bradshaw | 123/568 |

FOREIGN PATENT DOCUMENTS

| | | | |
|---|---|---|---|
| 2417001 | 4/1974 | Fed. Rep. of Germany | 123/568 |

*Primary Examiner*—Robert G. Nilson

*Attorney, Agent, or Firm*—C. H. Grace; R. A. Johnston

[57] ABSTRACT

Engine exhaust gas is recirculated by a fluid pressure actuated valve receiving a control signal from a controller which receives and modulates engine induction vacuum to provide a primary source and receives a carburetor throttle-blade controlled suction as a secondary source and compares the primary and secondary sources and discriminates therebetween to provide the lesser as the outward control signal.

7 Claims, 2 Drawing Figures

CONTROLLING EGR IN AN INTERNAL COMBUSTION ENGINE AND FLUID PRESSURE SIGNAL CONTROLLER THEREFOR

This is a division of application Ser. No. 379,844, filed May 20, 1982.

BACKGROUND OF THE INVENTION

The present invention relates to vacuum operated fluid pressure signal controllers and to controlling of exhaust gas recirculation (EGR) in an internal combustion engine by a vacuum actuated control valve.

In providing EGR for controlling emissions in automotive internal combustion engines, it is known to provide a valve for permitting exhaust gas to enter the engine induction manifold, which valve is controlled by a pressure responsive actuator receiving a fluid pressure control signal derived from an onboard source of subatmoshperic pressure such as manifold vacuum.

It has been found that different amounts of EGR are required at the various engine speeds and loads encountered in automotive engine service. Where engine manifold vacuum has been the primary source of fluid pressure control signal for effecting EGR, it has been found that the high vacuum or low manifold absolute pressure (MAP) which occurs at idle or nearly closed throttle engine operation requires that the vacuum signal be cut off to the EGR Actuator in order to prevent an excess amount of EGR at low engine operating speeds.

Where engine manifold vacuum has been utilized as a primary control signal for EGR valve actuation, it has been found convenient to invert the sense of the change of vacuum with variations in engine speed and load by means of a vacuum inverter. An example of such a device which has been heretofore employed is that shown and described in the copending application Ser. No. 185,467, filed Sept. 9, 1980, now U.S. Pat. No. 4,365,608, in the names of Cyril Bradshaw and Martin Uitvlugt and assigned to the Assignee of the present invention. The aforementioned device provides, (once a threshold operating level of input signal is achieved), for a decreasing vacuum output signal in response to increasing manifold vacuum, or decreasing MAP.

However, even where a vacuum inverter is employed, the inverted manifold vacuum signal is sufficiently large in magnitude as to cause the actuator to provide opening of the EGR valve and thus excess EGR at idle or low operating engine speeds.

Furthermore, engine manifold vacuum can have identical values for two different engine operating speeds, for example, idle and moderate road speeds. Thus, if manifold vacuum is employed for a control signal, the same amount of EGR would be provided at two different engine speeds where different amounts of EGR are required.

In conjunction with utilizing engine manifold vacuum as a controller signal source, it has been desired to also utilize a secondary vacuum source for controlling EGR at idle or low engine operating speed. Such a source is found in present day gasoline spark ignited automotive engines in the so-called "ported" signal tap provided in the carburetor throat at the throttle plate. A ported vacuum signal is so named because it is vented or "ported" to the atmosphere above the throttle plate in the closed position and is exposed to carburetor throat vacuum in the throttle plate open position. Ported vacuum exhibits zero gauge or atmospheric pressure at engine idle and increases vacuum, or decreases MAP, rapidly with a relatively small amount of throttle opening until the ported signal equals engine manifold vacuum.

However, if a ported vacuum signal is employed for each EGR valve actuator control, the control signal is at the requisite null or atmospheric pressure for engine idle, but increases too rapidly with throttle opening to be useful for a control signal over a broad range of engine operating conditions.

Thus, it has long been desired to find a way of providing a fluid pressure control signal for an EGR valve actuator over a broad range of engine operating conditions beginning with idle and progressing through wide open throttle, at various engine speeds and provide the desired amount of EGR for the engine instantaneous engine operating condition. It has particularly been desired to find a way of utilizing the available ported vacuum signal in conjunction with an engine manifold vacuum, or MAP, to provide a suitable control signal over the entire regime of engine operating conditions.

SUMMARY OF THE INVENTION

The present invention provides a solution to the above described problem by enabling an EGR valve actuator to be controlled by a subatmospheric fluid pressure control signal provided from onboard vehicle engine sources. The present invention enables control of the amount of EGR throughout the engine operating range encompassing idle and off-idle operation through wide open throttle at all normally encountered engine operating speeds.

The present invention provides a fluid pressure control signal for EGR valve actuation such that engine manifold vacuum or MAP is inverted with respect to the sense of change with increasing engine load. The inverted signal is used for controlling the EGR valve actuator. At idle and nearly closed throttle engine operating conditions, the ported carburetor throat vacuum signal is employed.

The signal controller of the present invention is capable of discriminating between the manifold vacuum signal and the carburetor throat signal and switching to the lesser of the two signals in order to effect the desired amount of EGR valve actuation.

The EGR valve actuator signal controller of the present invention employs a ball type switchover valve received in closely fitting sliding arrangement in a bore having a primary vacuum signal port at one end of the bore and a secondary vacuum signal port at the other end. The intermediate region of the bore is ported to provide an output vacuum control signal to the EGR valve actuator. A check ball moves between the position isolating the primary vacuum signal from the bore in which position the secondary vacuum signal comprising ported carburetor throat vacuum is applied to the actuator, and a second position in which the secondary vacuum signal is isolated from the bore and the primary signal comprising inverted manifold vacuum is applied to the actuator port.

The present invention thus provides a controller having the capability of switching between a primary and a secondary vacuum signal source in a manner as to select the lesser of the source signals.

The present invention incorporates a comparator function and is capable of transmitting the lesser vacuum signal. The controller has integrally an inverter for conditioning one of the vacuum source input signals, for example, engine manifold vacuum.

The present invention provides for controlling the amount of EGR in an engine proportional to carburetor throttle blade angle at idle and low off-idle engine operating condition and provides EGR proportional to changes in engine manifold vacuum throughout the remaining portion of the engine operating regime.

The present invention thus provides a unique and compact fluid pressure signal controller for effecting desired control of EGR throughout the full range of normal engine operation.

DETAILED DESCRIPTION

Figure 1:
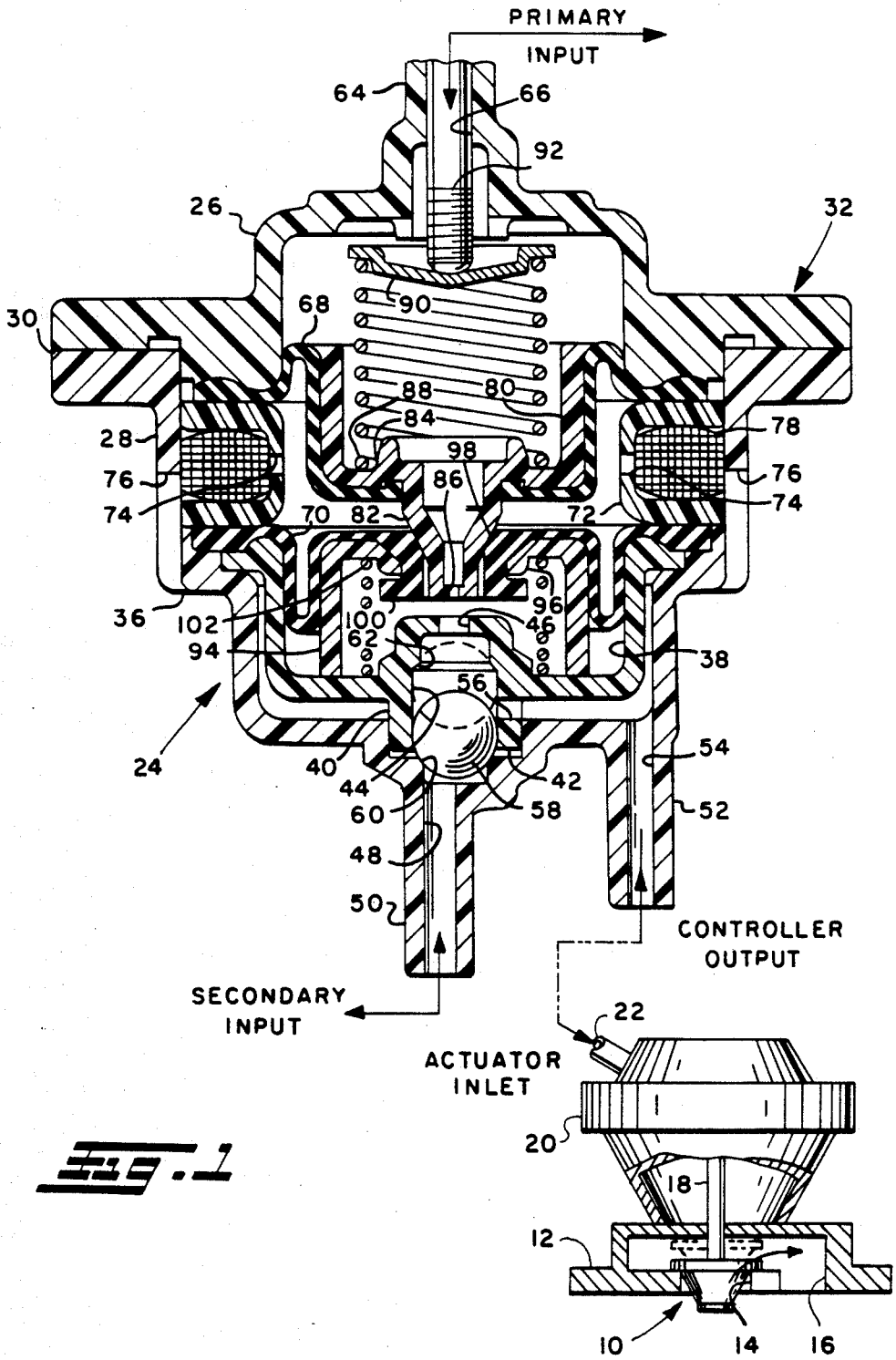
FIG. 1 is schematic showing a cross-section of the signal controller of the present invention and the fluid signal connections for EGR valve operation.

Referring now to FIG. 1, an EGR valve indicated generally as 10 has a housing 12 adapted for mounting on an engine to receive exhaust gas through orifice 14 and for recirculating exhaust gas through passage 16 upon opening of the valve. The EGR valve 10 is actuated by rod 18 connected to a pressure responsive member (not shown) such as a diaphragm disposed within housing 20 and having a signal inlet port 22. The signal inlet port 22 is connected by a suitable conduit indicated, by dashed lines in FIG. 1, to the output of a signal controller indicated generally at 24.

The signal controller 24 has a housing comprising an upper cover member 26, a central portion 28 joined to the upper cover at parting line 30 such that a flange indicated generally at 32 is formed the upper and central housing portions adjacent to parting line. In the presently preferred practice the invention the upper housing portion 26 and central portion 28 are formed of plastic material and joined about parting line 30 by a suitable expedient such as ultrasonic welding.

A lower housing portion 34 is received in the central housing portion 28 and is retained therein by any suitable technique as for example ultrasonic welding about the cylindrical parting line 36.

The lower housing portion 34 has an insert cup 38 received therein and suitably bonded as, for example, by sonic welding about the periphery of the cup to the lower housing portion 34. The cup 38 has a central tubular portion 40 extending downwardly therefrom and which is received in a recess 42 formed in the lower housing portion 34 and defining therebetween a fluid pressure chamber 44.

An orifice 46 is formed in the upper end of chamber 44 and a secondary fluid inlet port 48 is provided in the lower end of chamber 44. The port 48 extends externally of the housing through an attachment fitting 50 that is adapted for connection to a secondary vacuum supply hose.

A signal output attachment fitting 52 is provided on the lower housing portion 34 and has a port 54 provided therethrough which communicates via passage 56 formed in the tubular portion 40 of the insert cup with the fluid pressure chamber 44 intermediate the upper and lower ends thereof. A movable valve member 58 in the form of a checkball is received in closely fitting sliding engagement with the walls of chamber 44. The ball moves between a lower position indicated in solid outline in FIG. 1 contacting a secondary supply port seat 60 disposed about the port 48 and an upper position illustrated in dashed outline. In the upper position ball valve 58 engages a valve seat 62 formed in the interior of tubular portion 40 of the cup 38 and surrounding the orifice 46.

Upper housing portion 26 has a primary vacuum signal inlet attachment fitting 64 extending upwardly therefrom which has a port 66 provided therethrough and which is adapted for connection to a primary vacuum source hose.

An upper pressure responsive diaphragm 68 and a lower pressure responsive diaphragm 70 are received in the lower housing portion 34. The diaphragms are spaced vertically in FIG. 1 and individually sealed about the periphery thereof against their respective adjacent housing portions by a preferably "C" shaped spacer ring 72. A variety of vent ports 74 are provided about the spacer ring and the interior region of the spacer ring between the diaphragms is vented to the atmosphere via a plurality of slots 76 disposed about the periphery of the central housing portion 28. A packing 78 of suitable air filter material is disposed about the spacer ring 72 to prevent entry of foreign material to the space between the diaphragms.

The upper diaphragm 68 has an insert cup 80 received against the central portion thereof with the cup having a valve member 82 depending therefrom and extending downward through an aperture in the central portion of diaphragm 68. The diaphragm aperture has a sealing bead 84 disposed about the periphery thereof which seals against a corresponding groove in the cup 80.

The valve member 82 in the preferred practice of the invention has a tapered configuration with a fluid passage 86 provided centrally therethrough. A bias spring 88 has the lower end thereof received in cup 80 with the upper end registering against a shoulder provided peripherally about plate 90 which registers against an adjustable stop screw 92 provided in port 66.

Lower diaphragm 70 has an insert cup 94 received centrally therein and has a central opening therein with a downwardly turned flange 96 provided thereabout. The diaphragm 70 has a valve seat at 98 formed about a lip portion 100 which extends downwardly through the cup 94 and engages about the flange 96.

A bias spring 102 has the upper end thereof registering against the under surface of cup 94 with the lower end of the spring registering against the housing insert 38 for biasing the lower diaphragm and valve seat 98 in a vertically upward direction in FIG. 1 for contacting valve 82.

In operation, the controller 24 of FIG. 1 has the inlet fitting 64 connected to a vacuum hose supplied with a source of engine manifold vacuum. The secondary input attachment 50 is connected to a vacuum hose receiving a ported suction signal from the carburetor throat.

Figure 2:
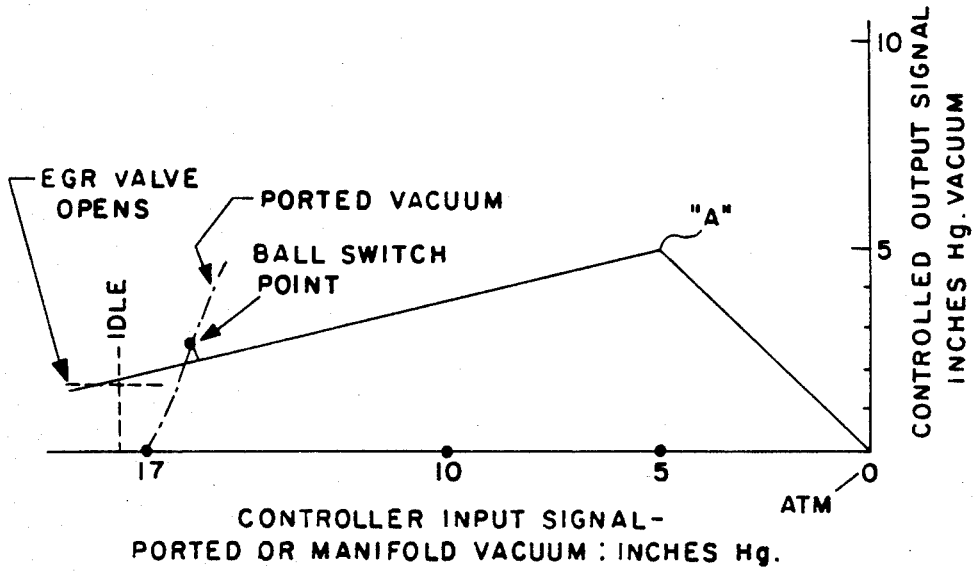
FIG. 2 is a graphical representation of the primary vacuum input signal plotted as the abscissa and the controller output signal plotted as the ordinate.

Referring to FIGS. 1 and FIG. 2, in operation, as the engine is running at idle with the throttle plate closed, a high vacuum is applied to the primary input port 66 which causes the pressure on the topside of diaphragm 68 and a slight vacuum to be formed below diaphragm 70 by bleed through the passage 86.

However, at high input vacuum levels through port 66, the pressure differential across upper diaphragm 68 causes valve 82 to open and vent atmospheric air to the chamber 44 through orifice 46 inversely as the vacuum varies in the input port 66.

With the ball 58 in the lower position shown in FIG. 1 in solid outline, the pressure in chamber 44 would be transmitted to output port 54 in accordance with the solid line plot of FIG. 2 and would continue to increase linearly from idle to point A on the graph of FIG. 2 in a manner inverted in the sense of change of manifold vacuum with increasing engine load. At point A on the graph of FIG. 2, the controller is no longer able to invert the input signal through port 66; and, thereafter at lighter engine loads the output to port 54 drops off in accordance with further decay in manifold vacuum as higher engine loads are encountered and reaches atmospheric pressure at wide open throttle.

As the primary input signal through port 66 decreases, diaphragm 68 and valve 82 are lowered to decrease the atmospheric bleed through valve seat 98 and thus increase the pressure below diaphragm 70 for increasing the signal to port 54.

With reference to FIG. 2, it will be seen that as the throttle plate is opened from closed position, the ported vacuum increases very rapidly from 0 to a value somewhat greater than the vacuum in chamber 44 and thus causes the ball 58 to move downwardly and remain in the position shown in solid outline in FIG. 1. In the presently preferred practice of the invention the clearance between ball 58 and chamber 44 is chosen so that a 0.3 inches of Hg pressure difference between the signal through orifice 46 and the signal in port 48 causes the ball to switch from the upper position, shown in dash lined FIG. 1, to the lower position shown in solid outline.

It will be understood that at or near the throttle plate closed position the check ball 58 is initially in the position shown in dashed outline in FIG. 1 closing off orifice 46 from the chamber 44 thereby causing the secondary or ported vacuum signal to be applied to chamber 44 and controller output port 54. Thus, at high manifold vacuum levels indicative of closed or nearly closed throttle plate position, the input control signal through port 54 is either 0 (atmospheric pressure) or is at a vacuum level provided through the secondary input port 48 from the carburetor ported vacuum source.

When the ported vacuum signal exceeds the inverted manifold vacuum signal present at orifice 46 by the selected differential, the check ball 58 moves downwardly or "switches" to thereafter apply the inverted manifold vacuum signal from orifice 46 to the controller output port 54.

From the foregoing description it will be seen that the present invention provides a unique method of controlling EGR to an engine by providing a control signal that utilizes the vacuum level of a ported carburetor throat vacuum signal at or near the closed throttle position and switches to an inverted manifold vacuum signal as the throttle opens to provide the desired control signal for an EGR valve actuator. The present invention thus provides a unique manner of controlling the EGR program of an engine over the range operating speeds and loads encountered in automotive service.

Although the invention here and above has been described in the presently preferred practice, it will be understood to those skilled in the art that modifications and variations may be made and the invention is limited only by the following claims.

We claim:

1. A fluid pressure signal controller comprising:

(a) housing means defining a fluid pressure chamber and having structure defining a primary inlet port thereto adapted for connection to a primary variable source of subatmospheric fluid pressure, said housing means including means defining a passage communicating said primary inlet port with said chamber;

(b) said housing means including structure defining a secondary fluid inlet port communicating with said chamber and adapted for connection to a secondary variable source of subatmospheric fluid pressure;

(c) said housing means including structure defining a signal outlet port communicating with said chamber;

(d) pressure responsive valve means disposed in said chamber and operative in response to the differences between the pressure in said passage and the pressure in said secondary port to move between a first position isolating said passage from said chamber and a second position isolating said secondary supply port from communicating with said chamber and permitting said passage to communicate with said chamber;

(e) said housing means including structure defining an atmospheric vent port communicating with said passage; and, (f) pressure responsive bleed means operative to modulate venting of said passage to said vent port in response to changes in pressure in said primary port and said passage, wherein said bleed means modulates said primary input port vacuum to provide a control signal in said chamber for said output port and said valve means switches between said first and second positions in response to one of the primary or secondary supply ports having the higher absolute pressure, for controlling the signal to said outlet port.

2. The device defined in claim 1, wherein said pressure responsive valve means comprises a spherical valve member disposed in closely fitting sliding arrangement in a bore with said secondary source port disposed at one end of said bore and an orifice communicating with said passage means disposed at the opposite end of said bore and said output port disposed intermediate the end of said bore.

3. The device claimed in claim 1 including means biasing said valve member toward said valve seat thereby tending to prevent flow from said vent port to said chamber.

4. The device defined in claim 1, wherein said pressure responsive valve means comprises a valve member in closely fitting sliding arrangement in a bore with said secondary source port disposed at one end of said bore and an orifice communicating with said passage means disposed at the opposite end of said bore and said output port formed intermediate the ends of said bore.

5. A fluid pressure signal controller for providing a vacuum control signal discriminative as between plural vacuum input signals, said controller comprising:

(a) housing means defining a fluid pressure chamber and including, (i) structure defining a first fluid pressure supply port and adapted for connection to a primary source of variable vacuum, (ii) structure defining a second fluid pressure supply port communicating with said chamber and adapted for connection to a secondary source of variable vacuum, (iii) structure defining a fluid pressure signal output port communicating with said chamber;

(b) bleed structure defining a fluid passage communicating said first port with said chamber, said structure including an atmospheric vent port and pressure responsive means operative to modulate the pressure in said chamber in response to pressure changes in said primary supply; and, (c) comparator means operative to discriminate between fluid pressure in said passage and said second port and to apply the lesser to said output port.

6. The device defined in claim 5, wherein said comparator means comprises a check valve member disposed in said chamber and operable to move between a final position isolating said passage from communicating with said chamber and a second position isolating said second supply port from communication with said chamber and permitting said passage to communicate with said chamber.

7. The device defined in claim 5, wherein said bleed structure includes a pair of spaced pressure responsive diaphragms isolating said vent port from said first supply port and said second chamber and bleed valve means to control bleed flow from said vent port to said passage.

* * * * *